US012668921B2

(12) United States Patent
Joos et al.

(10) Patent No.: US 12,668,921 B2
(45) Date of Patent: Jun. 30, 2026

(54) FLOW-OPTIMIZED EDGE TREATMENT

(71) Applicant: Voith Patent GmbH, Heidenheim (DE)

(72) Inventors: Uwe Joos, Königsbronn (DE); Daniel Gronych, Heidenheim (DE); Wolfgang Ruf, Herbrechtingen (DE); Tobias Henle, Ulm (DE); Michael Drescher, Kirchberg (AT)

(73) Assignee: Voith Patent GmbH, Heidenhem (DE)

( * ) Notice: Subject to any disclaimer, the term of this patent is extended or adjusted under 35 U.S.C. 154(b) by 467 days.

(21) Appl. No.: 18/129,216

(22) Filed: Mar. 31, 2023

(65) Prior Publication Data

US 2023/0235508 A1 Jul. 27, 2023

Related U.S. Application Data

(63) Continuation of application No. PCT/EP2021/075418, filed on Sep. 16, 2021.

(30) Foreign Application Priority Data

Oct. 2, 2020 (DE) ..... 10 2020 125 806.2

(51) Int. Cl.
*D21F 1/56* (2006.01)
*D21F 1/02* (2006.01)

(52) U.S. Cl.
CPC . *D21F 1/56* (2013.01); *D21F 1/02* (2013.01)

(58) Field of Classification Search
CPC ..... D21F 1/56; D21F 1/02
See application file for complete search history.

(56) References Cited

U.S. PATENT DOCUMENTS 3,361,620 A 1/1968 Gedemer
4,456,502 A 6/1984 Bollani
5,529,806 A * 6/1996 Eriksson ..... D21H 25/10 118/410
2015/0290899 A1* 10/2015 Ohira ..... B31F 1/2818 118/103

FOREIGN PATENT DOCUMENTS

DE 32 26 388 A1 1/1984
DE 20 2011 103 266 U1 1/2012

OTHER PUBLICATIONS

English translation of WO2013010975A1 retrieved from espacenet (Year: 2025).*
German Office Action dated Jun. 8, 2021 for German Patent Application No. 10 2020 125 086.2 (10 pages).
Notification of the Transmission of the International Search Report and Written Opinion of the International Search Authority or Declaration dated Jan. 5, 2022 for International Application No. PCT/EP2021/075418 (11 pages).

* cited by examiner

*Primary Examiner* — Abbas Rashid
*Assistant Examiner* — Elisa H Vera
(74) *Attorney, Agent, or Firm* — TAYLOR & EDELSTEIN, PC

(57) ABSTRACT

A flow body for a format control unit of a Fourdrinier wire machine for producing a web of fibrous material, includes: a flow dividing device which is configured for separating an edge strip from a fibrous stock suspension stream, in a region of a flow division the flow dividing device including a rounded edge with a curvature radius greater than 2 mm.

16 Claims, 2 Drawing Sheets

FLOW-OPTIMIZED EDGE TREATMENT

CROSS REFERENCE TO RELATED APPLICATIONS

This is a continuation of PCT application no. PCT/EP2021/075418, entitled "FLOW-OPTIMIZED EDGE TREATMENT", filed Sep. 16, 2021, which is incorporated herein by reference. PCT application no. PCT/EP2021/075418 claims priority to German patent application no. 10 2020 125 806.2, filed Oct. 2, 2020, which is incorporated herein by reference.

BACKGROUND OF THE INVENTION

1. Field of the Invention

The present invention relates to a flow body for a format control unit of a Fourdrinier wire machine for producing a fibrous web, in particular a paper or cardboard web, wherein the flow body includes a flow dividing device which is suitable for separating an edge strip from a fibrous stock suspension stream; it also relates to a format control unit having such a flow body, and the use of same in a Fourdrinier wire machine.

2. Description of the Related Art

A format control unit of this type is known for example from publication DE202011103266U1 and publication U.S. Pat. No. 4,456,502.

Due to the high flow velocities of approximately 500-1500 m/min, unsteady flow conditions repeatedly occur in practice in the region of the format control device and flow division. They result in particular in downstream surface waves originating from the web edge and moving towards the center of the web. Such surface waves can have a negative effect on the paper quality and the quality of the paper edge.

In the current state of the art, separation of the edge strip occurs by way of a plate or blade—see for example publication DE 20 2011 103 266 U1, paragraph 0012 to paragraph 0017—which dips into the fibrous stock suspension stream at an advantageous angle. However, in practice the blade causes a very direct flow break which results in an unsteady flow. In addition, individual fibers can adhere to the blade and agglomerate into so-called wads which, when they impact on the web, can also cause quality problems. Such wads can also lead to web breaks in subsequent process steps in paper manufacturing. The blade is typically characterized by a sharp edge, being wedge-shaped and a small wall thickness of less than 4 mm.

Another problem of unsteady edge treatment can also be droplets which can arise from the fibrous stock suspension stream and agglomerate, for example, on the surface of the format control unit or the flow body and which can also get onto the web in the form of wads.

What is needed in the art is to avoid these described disadvantages and to facilitate uniform flow of the fibrous stock suspension stream as well as uniform separation of the edge strip from the fibrous stock suspension stream. In particular, what is also needed in the art is to avoid waves in the fibrous stock suspension stream and on the web. These waves can occur if the flow does not remain parallel relative to the direction of web travel, but if instead, parts of the flow progress in a direction opposite to the direction of web travel.

SUMMARY OF THE INVENTION

With the embodiment according to the present invention, a clear equalization of the flow of the fibrous stock suspension stream can be achieved in the edge region. In addition, a reduction of wads or other contaminants in the region of the web edge can be achieved by the further features of the present invention.

A flow body for a format control unit of a Fourdrinier wire machine for producing a fibrous web, in particular a paper or cardboard web is advantageous, wherein the flow body includes a flow dividing device which is suitable for separating an edge strip from the fibrous stock suspension stream, wherein the flow dividing device in the region of the flow division has a rounded edge with a curvature radius greater than 2 mm, optionally greater than 3 mm to 18 mm.

Compared to the blades used in the current state of the art, the rounding of the flow-dividing device has shown in tests that a more uniform flow can be achieved in the region of the web edge. In addition, fewer fibers from the fibrous stock suspension stream adhere to the rounding, thus the possibility of wad formation is reduced. This applies in particular if the flow-dividing device is followed by a flow body having the same width, so that a smooth transition is ensured. In tests, a flow body width of 4 mm to 36 mm has proved particularly effective.

In an additional embodiment of the present invention the flow body can be designed such that the rounded edge of the flow-dividing device includes a rounding having a curvature radius in a semi-circular cross section, or at least a rounding which—in its cross section—includes a circular segment of greater than 90° to 180°.

A rounding on the flow-dividing device has shown to be advantageous, because a uniform flow along the surface is enabled. This is true in particular, if the flow body follows the flow-dividing device directly tangentially, thus having a width of 5 mm to 15 mm. If the rounding includes only a segment of a circle of greater than 90° to 180°, it is important that an edge thus formed on the segment of the circle is arranged on the side of the flow-dividing device facing away from the center of the web when the flow body is installed in accordance with the application, since at this edge the uniform flow can break off in an uncontrolled manner.

In an additional advantageous embodiment of the invention, the flow body is designed such that the rounded edge of the flow dividing device has a rounding that is elliptical or circle-like in cross-section, the dividing axis of which includes twice the length of the curvature radius.

In pre-trials of the present invention it was shown that merely the existence of the rounding has an equalizing effect on the flow dividing device. It is herein particularly advantageous if the flow body directly follows the flow dividing device having the same width. In an especially optional embodiment, the dividing axis of the rounding thus has a length of 4 to 36 mm.

In an additional advantageous embodiment of the present invention the flow body is designed so that the flow body has a lower edge which is arranged at an angle $\alpha$ relative to the flow dividing device, wherein angle $\alpha$ is designed in the range of 10° to 45°.

Depending on the flow velocity and flow properties of the fibrous stock suspension, it may also be advantageous for the flow-dividing device to follow a slightly concave or convex curvature. Angle $\alpha$ then refers to the one non-illustrated theoretical centerline of the concave or convex shape of the flow-dividing device.

In an additional advantageous embodiment of the present invention the flow body is designed so that the flow dividing device is arranged above the fibrous stock stream, thus having an angle α of 120° to 170° relative to the lower edge of the flow body.

The tests during the development of the present invention showed that reversed installation of the flow dividing device can also lead to a uniform partitioned flow. An additional flushing device is especially advantageous in this case, since otherwise fiber buildup can also occur at the bottom end of the flow-dividing device.

In an additional advantageous embodiment of the present invention the flow body is designed so that the flow body has a first side and a second side and that the flow dividing device is connected with a curved diverter element which is designed to divert a wave following the flow division from the first side to the second side of the flow body.

Due to the high flow velocities of 500 m/min to 1500 m/min of the fibrous stock suspension, the flow at the flow dividing device can subsequently be overflowed with fibrous stock suspension above the flow division or respectively the fibrous stock suspension stream. This described wave can be diverted by way of the described diverter element to the sides facing away from the center of the web and can be removed from the web with the edge strip.

In a further advantageous embodiment of the present invention, the flow body is designed such that the flow body includes a collecting device arranged in the region above the flow dividing device or the diverter element such that drops that may arise from the fibrous stock suspension stream and the edge strip in the region of the flow division are collected, wherein the collecting device is geometrically shaped such that the collected drops can be diverted away from the fibrous stock suspension stream.

The collecting device is advantageously designed in such a way that the collected drops are guided by the flow velocity, an air flow or gravity to the side of the flow-dividing device facing away from the web center, where they can be diverted in the format control unit.

One possible embodiment of the collecting device is for example a guard plate which is arranged above the flow dividing device in such a way that the drops can be diverted away from the web.

In a further advantageous embodiment of the present invention, the flow body is designed such that the flow body includes one or several flushing devices capable of discharging flushing water through a supply line and corresponding outlet openings on at least one side of the flow body.

The flushing device is suitable for reducing adhesions of fibrous material or contaminants on the side of the flow body and in the interior of the format control unit. An advantageous flow direction of the flushing water can also support the transportation of the edge strip. The flushing water can consist of pure water, process water or water with added cleaning agents, in particular detergents.

The flushing device may be designed as piping with relevant outlet openings or jets or may be integrated directly into the flow body by way of relevant hollow spaces and outlet openings, as shown in examples in FIG. 3 and FIG. 4. In addition it is also possible to arrange the flushing device below the lower edge of the flow body in such a way that no contaminants adhere to the flow body in that location. For good integration of the flushing device, it may also be advantageous to manufacture the flow body in an additive process.

The present invention further advantageously includes a format control unit in a Fourdrinier wire machine for producing a fibrous web, in particular a paper, cardboard or packaging paper web, including a flow body for immersion in a fibrous stock suspension stream, wherein the flow body is designed according to one of the aspects of the present invention.

The format control unit can also be advantageously designed in that the flow body can be easily replaced in the event of wear, optionally by way of a screw connection with the format control unit, and based on corresponding form-fit geometry is suitable for guiding the flow of the fibrous stock suspension stream without disturbances—for example due to larger edges or gaps—to the wire point of impact.

It can herein also be advantageous to manufacture the flow body cost effectively from plastic or metal. Wear can occur in particular due to abrasive substances in the fibrous stock suspension stream, making it necessary to replace the flow body when it loses the advantageous flow characteristics.

Also advantageous is the use of a format control unit in a Fourdrinier wire machine for producing a fibrous web, in particular a paper, cardboard or packaging paper web, from at least one fibrous stock suspension, including at least a continuous Fourdrinier wire revolving in the circumferential direction, a headbox which—via headbox a nozzle—applies the fibrous stock suspension in the form of a fibrous stock suspension stream over the width of the Fourdrinier wire to form a fibrous web, and including two format control devices, which are mounted on two opposite sides parallel to the web center of the Fourdrinier, wherein the format control units are suitable for separating an edge strip from the fibrous web in the region of the fibrous stock suspension stream and from the edge of the Fourdrinier, wherein the flow dividing device of the flow body is arranged at an angle α', in the range from 10° to 45°, relative to the plane of the Fourdrinier, or relative to the x-y axis.

It is moreover advantageous to use a format control unit according to one aspect of the present invention, wherein the format control unit is mechanically adjustable and wherein the adjustment is such that the flow dividing device can be adjusted in a defined manner in the range of 10° to 45° with respect to the plane of the Fourdrinier (x-y axis).

Experiments have shown that the exact positioning of the flow dividing device must be adjusted depending on the flow velocity and geometry of the fibrous stock suspension stream. Since the adjustment in the range of 10° to 45° is relatively small, it can be advantageous to make positioning possible, for example, with a locking screw or clamping device.

It is moreover advantageous in the use of the format control unit to design the format control unit so that it can be pivoted.

The ability to pivot is particularly important for wire changes, maintenance and cleaning tasks. A corresponding lever and an adjustment, for example by way of locking screws, can also be provided for this purpose. It is possible to pivot the format control unit parallel to the web, so that a distance of, for example, 10 cm between the format control unit and the paper web is possible. It is also possible to pivot the format control unit away from the web via a tilt axis so that better accessibility is achieved.

It can also be advantageous for the format control unit to be directly connected to a lateral edge control device, such as an edge limiting plate, or to form an integrated component with the latter, which can be pivoted together, for example.

Should the fibrous stock stream flow along the format control unit or along the deckle, it can also be advantageous to attach additional deflector elements to the format control unit or the subsequent deckle device in order to deflect this flow away from the paper web.

Additional advantageous embodiments of the present invention are explained by way of embodiment examples with reference to the drawings. The features mentioned can be advantageously implemented not only in the combination shown but can also be combined individually with one another.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawing, wherein.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF THE INVENTION

Figure 1:
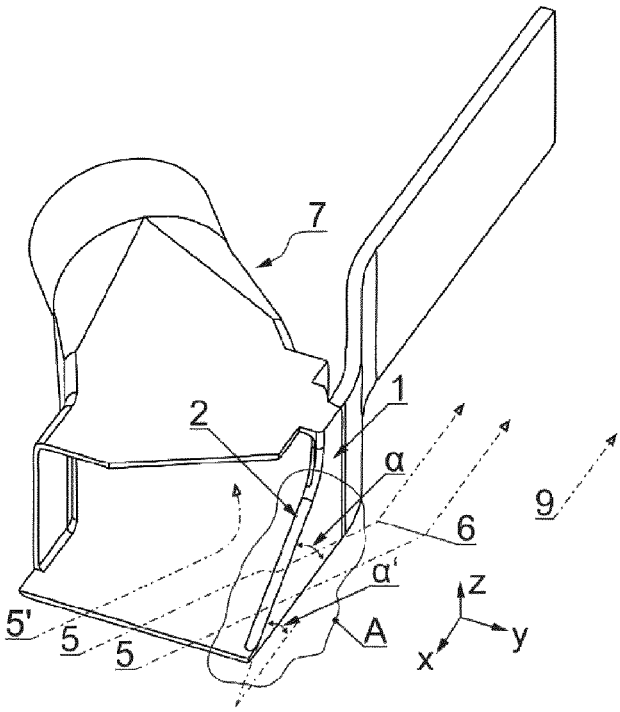
FIG. 1 shows a schematic perspective partial representation of a first embodiment of a format control unit with a flow body and a flow dividing device.

FIG. 1 shows a schematic perspective partial representation of a first optional embodiment of format control unit 7 with flow body 1 and flow dividing device 2. The fibrous stock suspension stream is shown via schematic flow lines 5, 5', wherein 5' represents the edge strip separated from the fibrous stock suspension stream. Fibrous stock suspension stream 5 impinges the Fourdrinier wire in the region of stream impingement point 6, which is not shown in detail, and the paper web is formed. The web center and direction of travel being shown as 9. To clarify the perspective view, a coordinate system with x-, y- and z-axis is shown, wherein the web plane of the Fourdrinier is formed by the x- and y-axis. Schematically shown area A is illustrated in the following figures in various embodiments. The flow of fibrous stock suspension stream 5 is in the x-z plane until the flow impinges on the wire. From then on the fibrous web is moved with the wire in the x-y plane.

Figure 2:
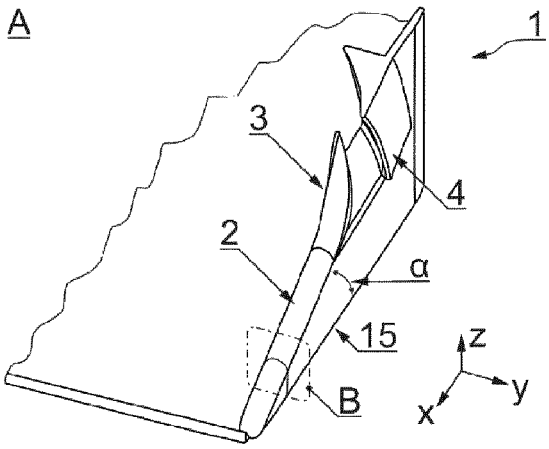
FIG. 2 shows a schematic perspective partial representation of an additional embodiment of a flow body and shows a possible section A of the embodiment shown in FIG. 1.

FIG. 2 shows a schematic perspective partial representation of an additional optional embodiment of flow body 1 and shows a possible section A of the embodiment shown in FIG. 1. Flow dividing device 2 is shown and connects positively to diverter element 3. In addition, a collecting device 4 is shown above the diverter element, which is suitable for collecting drops arising from fibrous stock suspension stream 5 and from the area of edge strip 5' and for discharging them with format control unit 7. The region marked B shows a sectional plane for the embodiments shown cross-sectionally in FIG. 3.

Figure 3:
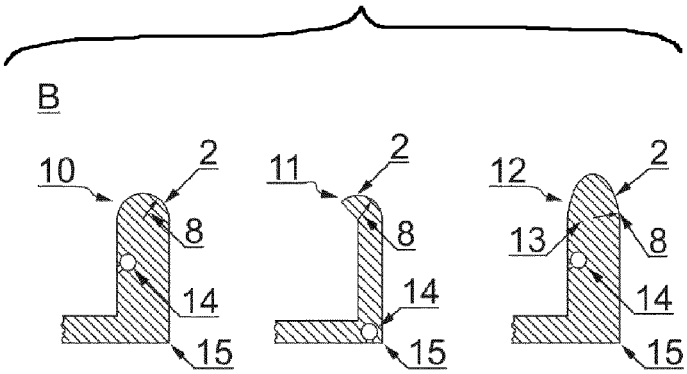
FIG. 3 is a schematic cross-sectional depiction of three embodiments for a flow body and a flow dividing device.

FIG. 3 is a schematic cross-sectional depiction of three optional embodiments for flow body 1 and flow dividing device 2. Flow-dividing device 2 is shown with a semicircular cross section 10, a cross section 11 of 90° to 180° and an elliptical or circle-like cross section 12. The embodiment with a cross section of 90° to 180° has an edge on the side facing away from web center 9, which causes a flow break. On the side facing web center 9, the circular element of the flow dividing device is positively connected with the flow body and also with format control unit 7. The embodiment with the elliptical or circle-like cross-section is also designed in such a way that a positive transition to the side of the flow body is provided, in particular on the side facing web center 9. All three optional embodiments also show a schematic optional flushing device 14 in various advantageous positions. Said flushing device has a supply line and outlet openings on at least one side of the flow body or below the lower edge of flow body 15. The flushing device can also be designed as a separate pipeline which is not shown and has a coupling valve which is not shown, connected to a flushing water supply not shown.

Figure 4:
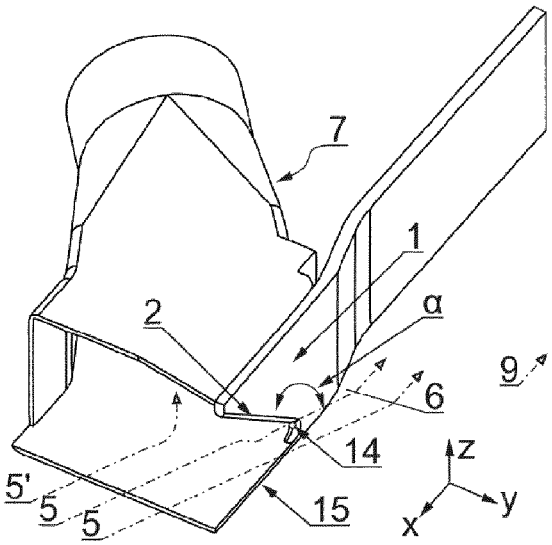
FIG. 4 shows a schematic perspective partial representation of an additional embodiment of a format control unit with a flow body and a dividing device.

FIG. 4 shows a schematic perspective partial representation of an additional optional embodiment of format control unit 7 with flow body 1 and dividing device 2. The fibrous stock suspension stream is illustrated via schematic flow lines 5, 5', wherein 5' represents the edge strip separated from the fibrous stock suspension stream. Fibrous stock suspension stream 5 impacts the Fourdrinier—which is not shown in detail—in the region of stream impingement point 6, and the paper web is formed, wherein the web center and direction of web travel is identified by number 9. For clarification of the perspective view, a coordinate system is shown with x-, y- and z-axis, wherein the plane of the paper web and the Fourdrinier is formed by the x- and y-axis. Compared to FIG. 1, flow dividing device 2 is merely reversed, meaning that, relative to the paper web, flow dividing device 2 is located above fibrous stock suspension stream 5.

COMPONENT IDENTIFICATION LISTING

1 Flow body
2 flow dividing device
3 diverter element
4 collecting device
5 fibrous stock suspension stream
5' edge strip
6 stream impingement point
7 format control unit
8 radius
9 web center and direction of travel
10 semi-circle cross section
11 cross section with circle segment greater than 90° to 180°
12 cross section with elliptical or circle-like shape
13 dividing axis
14 flushing device
15 lower edge of flow body While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A flow body for a format control unit of a Fourdrinier wire machine for producing a web of fibrous material, the flow body comprising:

a flow dividing device which is configured for separating an edge strip from a fibrous stock suspension stream, in a region of a flow division the flow dividing device including a rounded edge with a curvature radius greater than 2 mm, the rounded edge being round when viewing a cross-section—of the rounded edge—that is perpendicular to a machine direction of the Fourdrinier wire machine, the Fourdrinier wire machine—and thus also the flow body—having the machine direction and a cross-machine direction and lying in a coordinate system having an X-axis, a Y-axis, and a Z-axis, the X-axis extending in the machine direction, the Y-axis extending in the cross-machine direction, and the Z-axis extending vertically, the cross-section associated with the rounded edge lying in a Z-Y plane.

2. The flow body according to claim 1, wherein the web of fibrous material is a paper web or a cardboard web, the curvature radius being greater than 3 mm to 18 mm.

3. The flow body according to claim 1, wherein the rounded edge of the flow dividing device includes:

(a) a rounding having the curvature radius in a semi-circular cross section; or (b) at least a rounding which—in a cross section of the rounding—includes a circular segment of greater than 90°.

4. The flow body according to claim 1, wherein the rounded edge of the flow dividing device has a rounding or a curvature that is elliptical or circle-like in a cross-section, a dividing axis of the rounding including twice a length of the curvature radius.

5. The flow body according to claim 1, wherein the flow body includes a lower edge which is arranged at an angle $\alpha$ relative to the flow dividing device, wherein the angle $\alpha$ is within a range of 10° to 60°.

6. The flow body according to claim 5, wherein the angle $\alpha$ is within a range of 10° to 45°.

7. The flow body according to claim 1, wherein the flow body includes a lower edge which is arranged at an angle $\alpha$ relative to the flow dividing device, the flow body being configured such that the flow dividing device is arranged above the fibrous stock suspension stream, such that the angle $\alpha$ is in a range of 120° to 170°.

8. The flow body according to claim 1, wherein the flow body includes a first side, a second side, and a curved diverter element, the flow dividing device being connected with the curved diverter element which is configured for diverting a wave subsequent to the flow division from the first side to the second side of the flow body.

9. The flow body according to claim 8, wherein the flow body includes a collecting device arranged in a region of the flow body above the flow dividing device or the curved diverter element such that a plurality of drops that develop from the fibrous stock suspension stream and the edge strip in the region of the flow division are collected by the collecting device, wherein the collecting device is geometrically shaped such that the plurality of drops which are collected by the collecting device are diverted away from the fibrous stock suspension stream and the web of fibrous material.

10. The flow body according to claim 1, wherein the flow body includes at least one flushing device configured for discharging a flushing water through a supply line and a plurality of corresponding outlet openings on at least one side of the flow body.

11. A format control unit of a Fourdrinier wire machine for producing a web of fibrous material, the format control unit comprising:

a flow body configured for being immersed in a fibrous stock suspension stream, the flow body including:

a flow dividing device which is configured for separating an edge strip from the fibrous stock suspension stream, in a region of a flow division the flow dividing device including a rounded edge with a curvature radius greater than 2 mm, the rounded edge being round when viewing a cross-section—of the rounded edge—that is perpendicular to a machine direction of the Fourdrinier wire machine, the Fourdrinier wire machine—and thus also the flow body—having the machine direction and a cross-machine direction and lying in a coordinate system having an X-axis, a Y-axis, and a Z-axis, the X-axis extending in the machine direction, the Y-axis extending in the cross-machine direction, and the Z-axis extending vertically, the cross-section associated with the rounded edge lying in a Z-Y plane.

12. The format control unit according to claim 11, wherein the flow body is configured for being easily replaced in a case of wear, and, based upon a corresponding form-fit geometry of the flow body, the flow body is configured for guiding a flow of the fibrous stock suspension stream without a plurality of disturbances to a wire point of impact, wherein the web of fibrous material is a paper web, a cardboard web, or a packaging paper web.

13. The format control unit of claim 12, wherein the flow body is mounted by way of a screw-connection or a clamp-connection in the format control unit, and, based upon the corresponding form-fit geometry of the flow body, the flow body is configured for guiding the flow of the fibrous stock suspension stream without the plurality of disturbances due to a plurality of larger edges or gaps to the wire point of impact.

14. A method of using a format control unit of a Fourdrinier wire machine for producing a web of fibrous material, the method comprising the steps of:

providing that the Fourdrinier machine is configured for producing the web of fibrous material from at least one fibrous stock suspension and that the format control unit includes a flow body, which includes a flow dividing device which is configured for separating an edge strip from a fibrous stock suspension stream, in a region of a flow division the flow dividing device including a rounded edge with a curvature radius greater than 2 mm, the rounded edge being round when viewing a cross-section—of the rounded edge—that is perpendicular to a machine direction of the Fourdrinier wire machine, the Fourdrinier wire machine—and thus also the flow body—having the machine direction and a cross-machine direction and lying in a coordinate system having an X-axis, a Y-axis, and a Z-axis, the X-axis extending in the machine direction, the Y-axis extending in the cross-machine direction, and the Z-axis extending vertically, the cross-section associated with the rounded edge lying in a Z-Y plane;

revolving at least a Fourdrinier wire-which is continuous-in a circumferential direction;

applying, by way of a headbox nozzle of a headbox, the at least one fibrous suspension formed as the fibrous stock suspension stream over a width of the Fourdrinier wire to form the web of fibrous material; and mounting two of the format control unit on two opposite sides parallel relative to web center of the Fourdrinier wire, the two of the format control unit being configured for separating the edge strip from the fibrous stock suspension stream in a region of the fibrous stock suspension stream and from an edge of the Fourdrinier wire, the flow dividing device of the flow body being arranged at an angle ($\alpha'$) in a range from 10° to 45° relative to a plane of the Fourdrinier wire machine (x-y axis).

15. The method of using the format control unit according to claim 14, wherein the format control unit is configured for being mechanically adjustable, and wherein an adjustment of the format control unit is such that the flow dividing device is configured for being adjusted in a defined manner in a range of 10° to 45° with respect to the plane of the Fourdrinier wire machine (x-y axis), wherein the web of fibrous material is a paper web, a cardboard web, or a packaging paper web.

16. The method of using the format control unit according to claim 14, wherein the format control unit is configured for being pivoted away from the web of fibrous material.

* * * * *